US012102157B2

(12) United States Patent
Harroch

(10) Patent No.: US 12,102,157 B2
(45) Date of Patent: Oct. 1, 2024

(54) HEAD COVERING SYSTEM WITH FIREARM STORAGE

(71) Applicant: Mordekhai Harroch, Frisco, TX (US)

(72) Inventor: Mordekhai Harroch, Frisco, TX (US)

( * ) Notice: Subject to any disclaimer, the term of this patent is extended or adjusted under 35 U.S.C. 154(b) by 298 days.

(21) Appl. No.: 17/889,273

(22) Filed: Aug. 16, 2022

(65) Prior Publication Data

US 2022/0386729 A1 Dec. 8, 2022

Related U.S. Application Data

(63) Continuation-in-part of application No. 17/143,174, filed on Jan. 7, 2021, now abandoned.

(60) Provisional application No. 63/082,753, filed on Oct. 19, 2020.

(51) Int. Cl.

| | |
|---|---|
| ***A42B 1/241*** | (2021.01) |
| ***F41C 33/02*** | (2006.01) |
| ***F41C 33/04*** | (2006.01) |

(52) U.S. Cl.

CPC ..... *A42B 1/241* (2013.01); *F41C 33/0218* (2013.01); *F41C 33/048* (2013.01)

(58) Field of Classification Search

CPC ..... A42B 1/241; F41C 33/0218; F42B 39/02

See application file for complete search history.

(56) References Cited

U.S. PATENT DOCUMENTS

| | | | | |
|---|---|---|---|---|
| 3,505,682 A * | 4/1970 | Mims | A42B 1/241 | 2/171.1 |
| 4,472,837 A * | 9/1984 | Saxton | A42B 1/241 | 2/171.4 |
| 6,023,788 A * | 2/2000 | McCallum | A42B 1/241 | 2/209.13 |
| 6,131,201 A * | 10/2000 | Chu | A42B 1/0187 | 2/172 |
| 2017/0176145 A1* | 6/2017 | Libal | A42B 1/006 | |

* cited by examiner

*Primary Examiner* — Corey N Skurdal
(74) *Attorney, Agent, or Firm* — Kenyon Jenckes

(57) ABSTRACT

A head covering system for securely storing and retrieving a firearm stored inside is provided. The firearm is stored inside an interior hollow section in a concealed manner inside the head covering section as the interior hollow section is covered by a closing section in a way that visually blends the closing section with the rest of the head covering system. In an embodiment, magnets may be attached to the top of interior of the hat to secure a firearm.

4 Claims, 4 Drawing Sheets

HEAD COVERING SYSTEM WITH FIREARM STORAGE

CROSS-REFERENCE TO RELATED APPLICATIONS

This application claims priority to U.S. Provisional Application Ser. No. 63/082,753, filed Sep. 24, 2020, and U.S. patent application Ser. No. 17/143,174, filed Jan. 7, 2021, and entitled "HEAD COVERING SYSTEM WITH FIREARM STORAGE", the entirety of which are incorporated by reference.

TECHNICAL FIELD

The technical field of the disclosed embodiments relate to the field of head covering systems. More particularly, the disclosed embodiments relate to a head covering system that allows a user of the head covering system to store a firearm inside the head covering system.

BACKGROUND

A variety of head covering systems with capability to store objects inside are known for quite some time now. However, all of the known head covering systems with object storage capability facilitate storage of simple, everyday use items, such as keys, credit cards, paper money, coins, driver's license and objects of similar nature.

None of the existing head covering systems provide storage facility for firearms as this would require specifically designed storage space in each head covering system compatible to one or more known firearms.

There is therefore a need in the art for a head covering system that allows to securely store a firearm in a concealed manner without impeding activities of a wearer.

SUMMARY

Disclosed are various embodiments of a head covering system for storing and securing a firearm. In an embodiment, the hat covering system includes a hat portion with a top portion, a rim, and a fastening material positioned along a circumference of the rim. Magnets may be attached to the top inner portion of the hat and arranged in a pattern approximating the shape of a firearm. The magnets may be permanent magnets and made from magnetic materials such as ceramic, Alnico, and neodymium.

An insert may have a fastening material adapted to engage with the fastening material along the circumference of the rim. The insert may be adjusted to change the inner diameter of the hat to better fit the user's head, and also adjusted to raise or lower the height of the hat on the user's head.

DETAILED DESCRIPTION

In an embodiment, a head covering system may include storage for a firearm, and also hold the firearm securely in place while a wearer of the head covering system moves around and performs any of his or her usual day to day activities. The head covering system may store the firearm in a concealed manner without appearing significantly different from any of the existing head covering systems.

Figure 1:
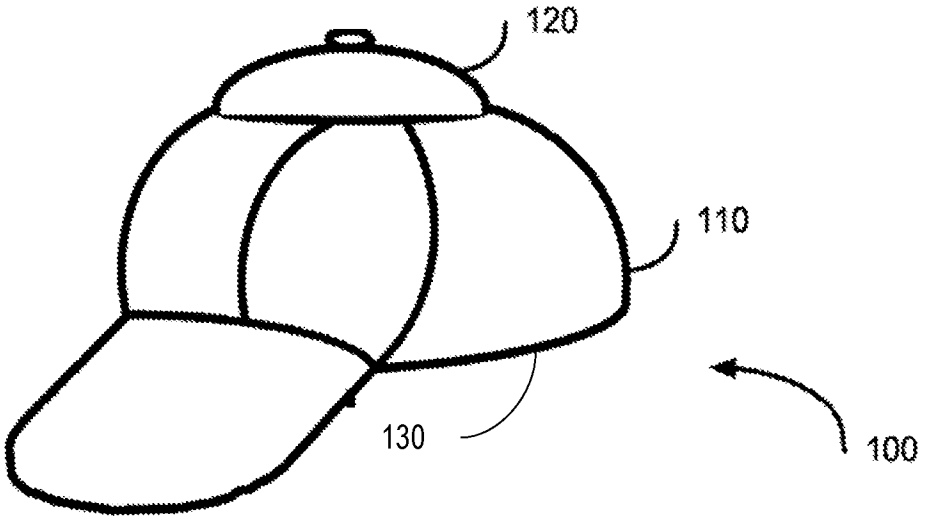
FIG. 1 is a perspective view showing a head covering system according to an embodiment.

FIG. 1 shows a head covering system 100 according to an embodiment. The head covering system 100, for example, a baseball-style cap, includes a first, top portion 110 and a second, bottom portion 120 including the hat rim, as shown in FIG. 1. The cap 100 further comprises an interior hollow section 140 which is formed by the top portion 110 and the bottom portion 120, as shown in FIG. 2.

The top portion 110 and the bottom portion 120 can be connected at one or more points. While the top portion 110, stays on the head of a user and hence, fixed in place, the bottom portion 120 can be moved away from the top portion 110 by rotating the bottom portion 110 along an axis of rotation 130 defined by the one or more points and in the process providing access to the user to the interior hollow section 140.

Figure 2:
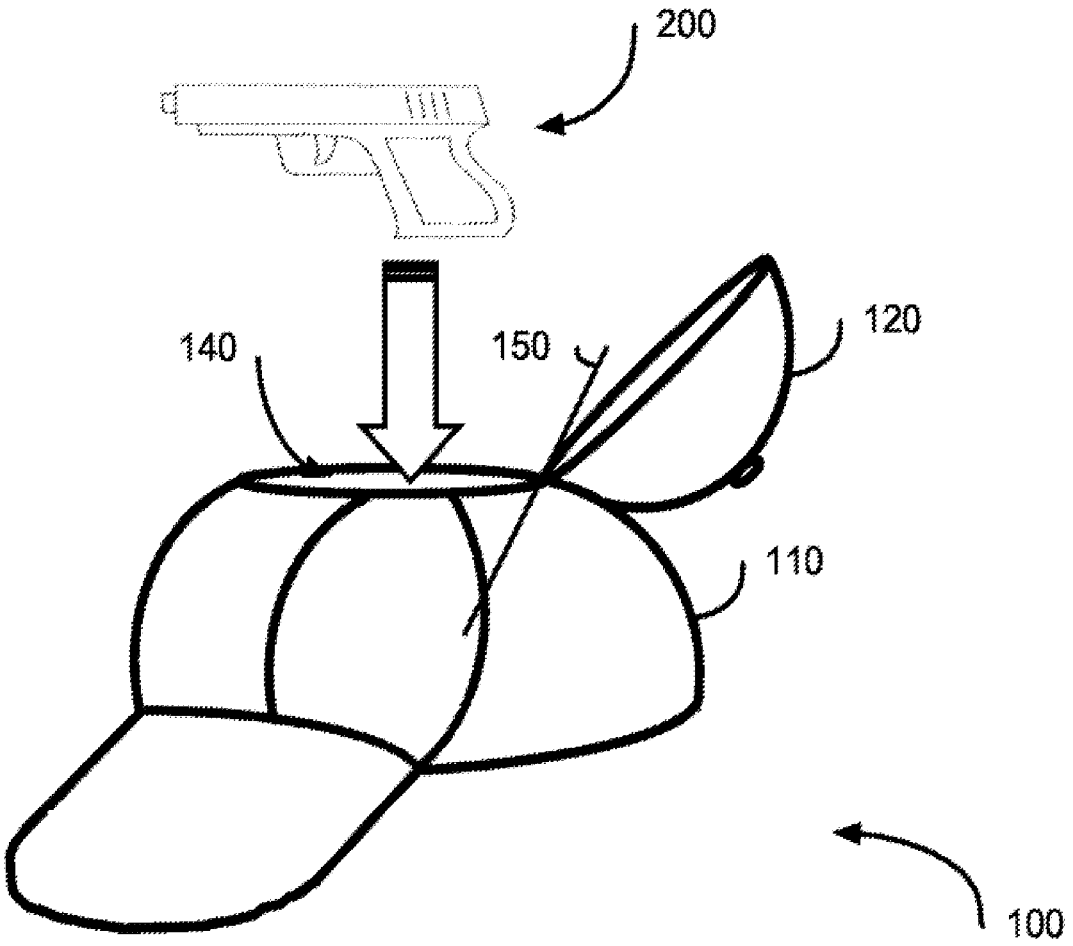
FIG. 2 is a perspective view showing an interior hollow section of the head covering system designed to store a firearm according to an embodiment.

In an embodiment, the bottom portion 120 may rotate along an axis 150 transverse to the crown of the user, that is, flip up, as shown in FIG. 2. In another embodiment, the bottom portion 120 may rotate along a perpendicular axis to the crown and floor, as shown in FIG. 1.

The top portion 110 and the bottom portion 120 are held in place using a locking mechanism (not shown in the figures). As will be understood to a person of ordinary skill in the art, a variety of locking mechanism known in the existing arts can be used for this purpose, for example, hook-and-loop fasteners, e.g, Velcro®, snapping button(s), hinged fasteners, stitching, etc.

The interior hollow section 140 may include a fixed or insertable receiving module shaped to match the shape and the size of a firearm 200, allowing the interior hollow section 140 to receive the firearm 200 in a manner that the firearm 200 fits snugly inside the interior hollow section 140. The receiving module may be made from, for example, foam or plastic.

In an embodiment, the interior hollow section 140 including the receiving module may allow for space, e.g., a compartment, to store ammunition, in addition to a compartment shaped to hold a loaded magazine for the firearm 200, which may also be loaded with another magazine.

In an embodiment, the interior hollow section 140 including the receiving module may have shaped compartments of a suitable size and shape to store objects, in addition to the firearm 200, for example, keys, credit cards, paper money, coins, driver's license and objects of similar nature. The compartments for storage of such objects may be arranged in a manner so as to not interfere with the secure storage of the firearm 200 while storing or retrieving such objects. Further, storing or retrieving the firearm 200 would not be obstructed due to presence of such objects stored inside the interior hollow section 140.

As will be understood to a person of ordinary skill in the art, one or more firearms could be of similar shape and size and hence, more than one make and model of firearm may fit inside the interior hollow section of the cap. Also, at the same time, as firearms could be of varying shapes and sizes, different designs of the interior hollow section and hence, different caps, or insertable receiving modules, may be required to permit the intended function of receiving a firearm snugly inside the interior hollow section 140.

A snug fit of the interior hollow section 140 to the stored firearm 200 is important to ensure the firearm 200 does not move independently inside the interior hollow section 140 in response to any activity performed by a wearer of the cap 100. Such independent movement(s) by the firearm 200 could pose a safety issue for the wearer and any people nearby, as the independent movement may cause the firearm 200 to accidentally discharge. Further, such an independent movement of the firearm 200 may generate forces inside the interior hollow section 140 which may cause the cap 100 to dislodge from the head of the wearer and fall off altogether. If the cap 100 falls off on a person or an object from the head of the wearer due to the independent movement of the firearm 200 inside, the combined weight of the cap 100 and the firearm 200 may cause hurt and/or damage to the person or the object.

As per the exemplary embodiment of the present invention, the cap 100 may include a closing section to cover the interior hollow section 140 in such a manner that the interior hollow section 140 is not visible from outside once the closing section is moved into place. To achieve this, edges of the closing section are designed to fit the outer visible edges of the interior hollow section 140 with a narrow range of tolerance, ensuring the closing section visually blends with rest of the cap 100.

In an embodiment, one or more edges of the closing section may be attached to one or more of the edges of the interior hollow section 140. With the attached one or more edges providing one or more axis for movement, the closing section could then open and close, as per the requirements of the wearer of the cap 100, facilitating secure storage or retrieval of the firearm 200 from the interior hollow section 140. Movement along the one or more attached edges could be facilitated using a variety of methods known in the existing art. A non-limiting example of such a movement could be an attached edge permitting rotation along an axis transverse or perpendicular to a floor of a level room.

In an embodiment, the opening and closing of the closing section would also facilitate storage or retrieval of objects, such as keys, credit cards, paper money, coins, driver's license and objects of similar nature.

The closing section could be attached to the rest of the cap 100 using a fastening means. A non-limiting example of such a fastening means could be Velcro® strips. As will be understood to a person of ordinary skill in the art, a variety of fastening means could be used to secure the closing section enabling the intended function of covering the interior hollow section 140.

Figure 3:
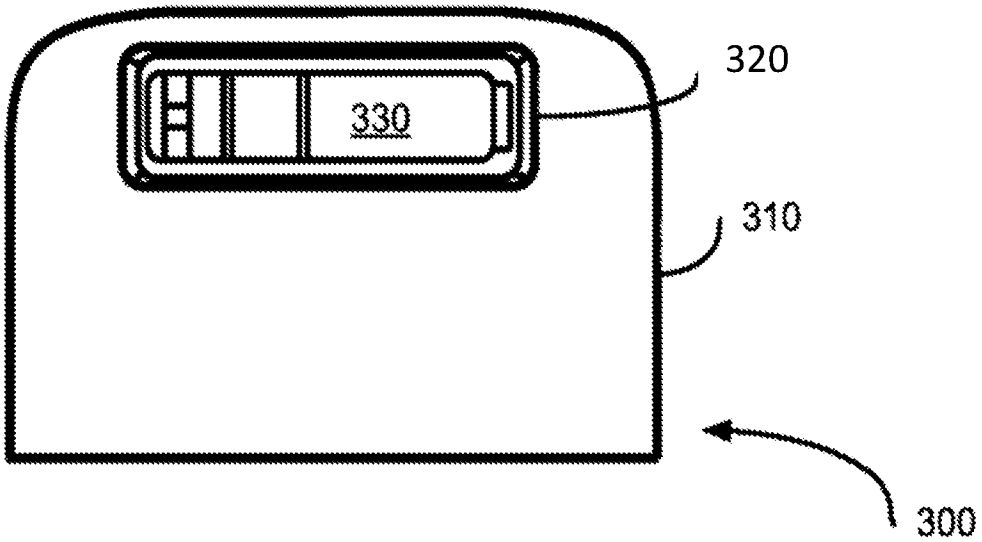
FIG. 3 is a rear view of a head covering system according to an embodiment, which shows an interior hollow section, designed to store a firearm, accessible from an opening at the back of the head covering system.

FIG. 3 shows another exemplary embodiment of the present invention where a head covering system 300 comprises a cap 310. The cap 310 comprises an interior hollow section 320, located on the top portion of the cap 310, accessible from the rear side of the cap 310, as shown in the FIG. 3. Similar to the interior hollow section 140, the interior hollow section 320 may be designed to match the shape and the size of a firearm 330, allowing the firearm 330 to fit snugly. Further, similar to the interior hollow section 140, the interior hollow section 310 may allow storage of ammunition and loaded magazines, and objects of personal use, such as keys, credit cards, paper money, coins, driver's license and objects of similar nature.

Figure 4:
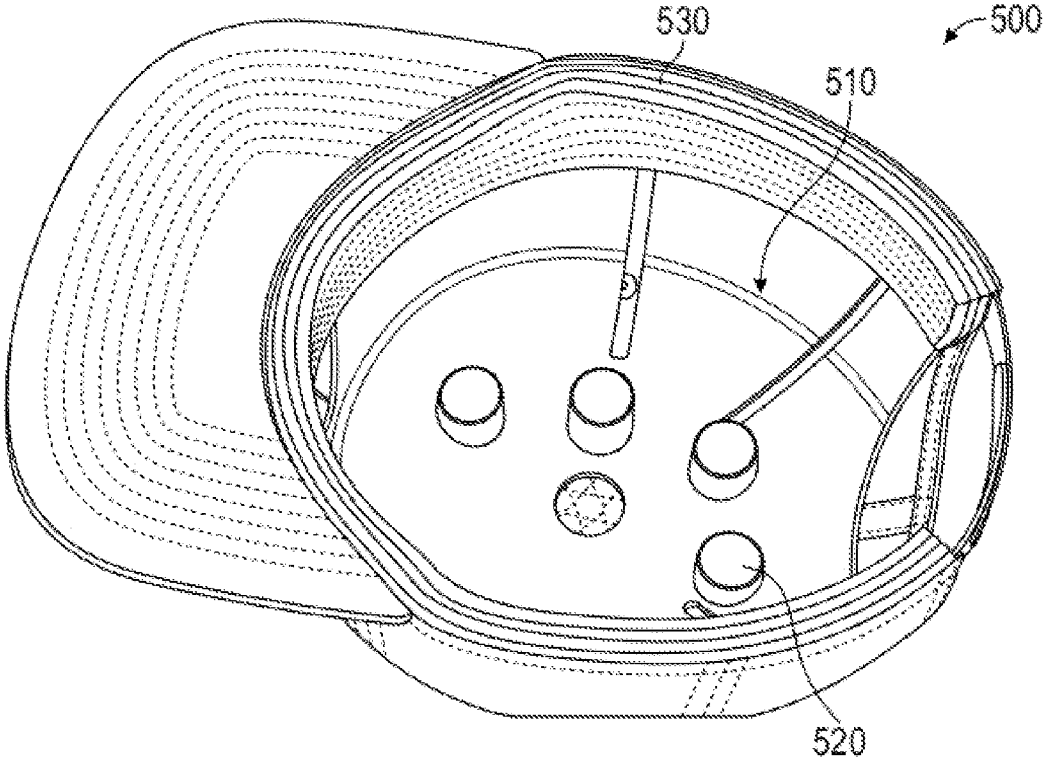
FIG. 4 is a perspective view of another embodiment including magnets to secure a firearm.

In another embodiment, a hat covering system 500, for example a baseball-style cap, may include magnets 510 to the top portion of the cap, as shown in FIG. 4. The magnets 510 may be arranged in a pattern matching the shape of a firearm. The magnets 510, individually and in combination, must have a sufficiently strong magnetic field to securely hold the firearm in place even in the event of actions made by the user, for example, walking, running, taking the cap on and off, etc., but must not be so strong that the user cannot disengage the firearm once attached. Strong permanent magnets are commonly made from ceramic (ferrites), Alnico (an alloy of aluminum, nickel, and cobalt), and neodymium, although other types of magnets may be used.

The hat covering system 500 may also include an insert 530 which may be releasably attached to the inner rim of the hat. In an embodiment, the insert 530 may be attached to the hat with a hook-and-loop fastener, e.g., Velcro®. The insert may be adjust to fit the diameter of the user's head, for example by overlapping the ends for a smaller diameter. The insert may also be adjusted to increase or decrease the height of the hat on the user's head by attaching the insert lower or higher, respectively, on the hat rim.

The foregoing method descriptions and diagrams/figures are provided merely as illustrative examples and are not intended to require or imply that the operations of various aspects must be performed in the order presented. As will be appreciated by one of skill in the art, the order of operations in the aspects described herein may be performed in any order. Words such as "thereafter," "then," "next," etc. are not intended to limit the order of the operations; such words are used to guide the reader through the description of the methods and systems described herein. Further, any reference to claim elements in the singular, for example, using the articles "a," "an," or "the" is not to be construed as limiting the element to the singular.

The preceding description of the disclosed aspects is provided to enable any person skilled in the art to make, implement, or use the claims. Various modifications to these aspects will be readily apparent to those skilled in the art, and the generic principles defined herein may be applied to other aspects without departing from the scope of the claims. Thus, the present disclosure is not intended to be limited to the aspects illustrated herein but is to be accorded the widest scope consistent with the claims disclosed herein.

The invention claimed is:

1. A hat covering system comprising:

a hat including a top portion, a rim having a circumference, and a fastening material positioned along the circumference of the rim;

a plurality of magnets attached to the top portion of the hat and arranged in a pattern approximating the shape of a firearm; and an insert having a width and a height and including a fastening material adapted to engage with the fastening material along the circumference of the rim, wherein the insert is configured to be adjusted to a user selected inner diameter and a user selected height of the hat on the user's head.

2. The hat covering system of claim 1, wherein each of the plurality of magnets comprise permanent magnets.

3. The hat covering system of claim 1, wherein each of the plurality of magnets comprise a magnetic material selected from ceramic, Alnico, and neodymium.

4. The hat covering system of claim 1, wherein the fastening material on the rim and the fastening material on the insert comprise a hook-and-loop fastener material.

* * * * *